US008210734B2

(12) United States Patent
Wu

(10) Patent No.: US 8,210,734 B2
(45) Date of Patent: Jul. 3, 2012

(54) COMBINATIONAL LED LAMP

(76) Inventor: Yih-Jang Wu, Lujhu Township, Taoyuan County (TW)

( * ) Notice: Subject to any disclaimer, the term of this patent is extended or adjusted under 35 U.S.C. 154(b) by 410 days.

(21) Appl. No.: 12/457,614

(22) Filed: Jun. 17, 2009

(65) Prior Publication Data

US 2010/0046237 A1 Feb. 25, 2010

(30) Foreign Application Priority Data

Aug. 21, 2008 (TW) ..... 97131898 A

(51) Int. Cl.
*H01R 33/00* (2006.01)

(52) U.S. Cl. ..... 362/647; 362/652; 362/655; 362/656; 362/657; 362/658; 362/659; 362/249.02

(58) Field of Classification Search ..... 362/647–659, 362/227, 249.01–249.03, 249.14–249.18
See application file for complete search history.

(56) References Cited

U.S. PATENT DOCUMENTS

| | | | | |
|---|---|---|---|---|
| 5,660,461 | A * | 8/1997 | Ignatius et al. | 362/241 |
| 7,553,162 | B2 * | 6/2009 | Isoda et al. | 362/249.01 |
| 7,832,897 | B2 * | 11/2010 | Ku | 362/249.02 |
| 2005/0007780 | A1 * | 1/2005 | Feuerborn et al. | 362/257 |

* cited by examiner

*Primary Examiner* — William Carter
(74) *Attorney, Agent, or Firm* — Bacon & Thomas, PLLC

(57) ABSTRACT

A combinational LED lamp includes an insulating housing, a first conductive contact, a second conductive contact, and an LED body. The insulating housing includes a first engaging surface with a first engaging portion and a second engaging surface with a second engaging portion. The first engaging portion is engaged with the second engaging portion. The two conductive contacts are all fixed on the insulating housing. Both the two conductive contacts include an integral internal section and two exposure sections exposing at the first engaging surface and the second engaging surface of the insulating housing. Two terminals of the LED body are each electrically connected with the internal section of the first conductive contact and of the second conductive contact. Therefore, multiple LED-lamp units can be incorporated so as to form various configurations of LED-lamp combinations.

8 Claims, 7 Drawing Sheets

COMBINATIONAL LED LAMP

BACKGROUND OF THE INVENTION

1. Field of the Invention

The present invention relates to an LED (light-emitting diode) lamp, and more particularly, to an LED lamp combinable to various configurations with different LED-lamp units.

2. Description of Related Art

Since lighting fixtures were invented, electric lamps vary significantly in terms of structure, pattern, type of use and illumination effect. Tungsten lamps and fluorescent lamps used to be the most popular lighting fixtures. LEDs, in use of semi-conductor technique, have been applied to illumination devices gradually due to lightweight, compact size, power saving and sufficient illumination.

Nowadays lighting fixtures available in the market are mostly related to lamps constructed by single lamp units, such as streetlamps; or plural lamps arranged in arrays for specific purposes, such as advertisement boards assembled on a common base with plural single lamps so as to broaden illumination surfaces.

Therefore, to develop flexible lamp unit combinations so as to vary configurations of lighting fixtures and to breakthrough traditional lamps of single utilization becomes an object of the present invention.

SUMMARY OF THE INVENTION

The present invention is to provide a combinational LED lamp, comprising an insulating housing, a first conductive contact, a second conductive contact, and an LED body. The insulating housing includes at least one engaging-side set, wherein the engaging-side set includes a first engaging surface and a second engaging surface. A first engaging portion is formed on the first engaging surface and that a second engaging portion on the second engaging surface, wherein the first engaging portion is engaged with the second engaging portion. The LED body, the first conductive contact and the second conductive contact are all fixed on the insulating housing.

Both the first and the second conductive contacts include an integral internal section and at least one external-section set corresponding to the engaging-side set. The internal section is located inside the insulating housing, and that the external-section set includes two exposure sections exposing at the first engaging surface and the second engaging surface of the insulating housing respectively. A first terminal of the LED body is electrically connected with the internal section of the first conductive contact, and that a second terminal of the LED body with the internal section of the second conductive contact.

Through the above-mentioned structure, the combinational LED lamp, according to the present invention, can be developed by incorporating multiple LED-lamp units so as to form various configurations of LED-lamp combinations. Since there is no need to make a lamp structure of specific configurations, the combinational LED lamp, according to the present invention, is considerably flexible in combination.

In the present invention, the insulating housing may be formed as a right polygonal column, particularly a right polygonal column of even-number sides, such as a right hexagonal column. Besides, the first and the second engaging surfaces can be designed as neighboring sides, such that the right hexagonal column has three engaging-side sets so as to constitute six sides of the right hexagonal column. Therefore, the combinational LED lamps, according to the present invention, will have a greater extent of variation in combinations. In use of the insulating housing of right polygonal column, a subsequent combination of LED-lamp units will have a better expectability, and this is a consequentiality of geometric configurations.

In order to proceed with molding conveniently, the insulating housing can be designed to be constructed by three unit bodies stacked up from one another in sequence, where the first conductive contact and the second conductive contact are each interposed, respectively, between neighboring unit bodies.

The first engaging portion may be formed as a wedge-like slot, while the second engaging portion as a wedge-like block, where the wedge-like slot and the wedge-like block are particularly developed longitudinally.

The first conductive contact and the second conductive contact may be spaced apart, longitudinally, from each other at a predetermined distance. Both the internal section of the first conductive contact and of the second conductive contact are each provided with an opening so as to pass therethrough an elastic piece which is inclined longitudinally. The first terminal passes through the opening of the first conductive contact and abuts against the elastic piece corresponding thereto, and the second terminal passes through the two openings and abuts against the other elastic piece.

According to the present invention, the combinational LED lamp may further comprise an electric adapter including an engaging structure and a positive-negative-terminal set, wherein the engaging structure can be engaged with the first engaging portion of the insulating housing, and the positive-negative-terminal set exposes from the engaging structure so as to contact the exposure section of the first conductive contact and the exposure section of the second conductive contact. Therefore, the electric adapter can be engaged, securely, with the insulating housing so as to supply electric power continuously. In addition, the combinational LED lamp, according to the present invention, can be located more flexibly because there are plenty of choices for locations at which electric power is connected.

Further, according to the present invention, the electric adapter may be provided with a hanging hole such that the combinational LED lamps, after combination, can be hanged, integrally, on wall or on a signboard, through the electric adapter.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
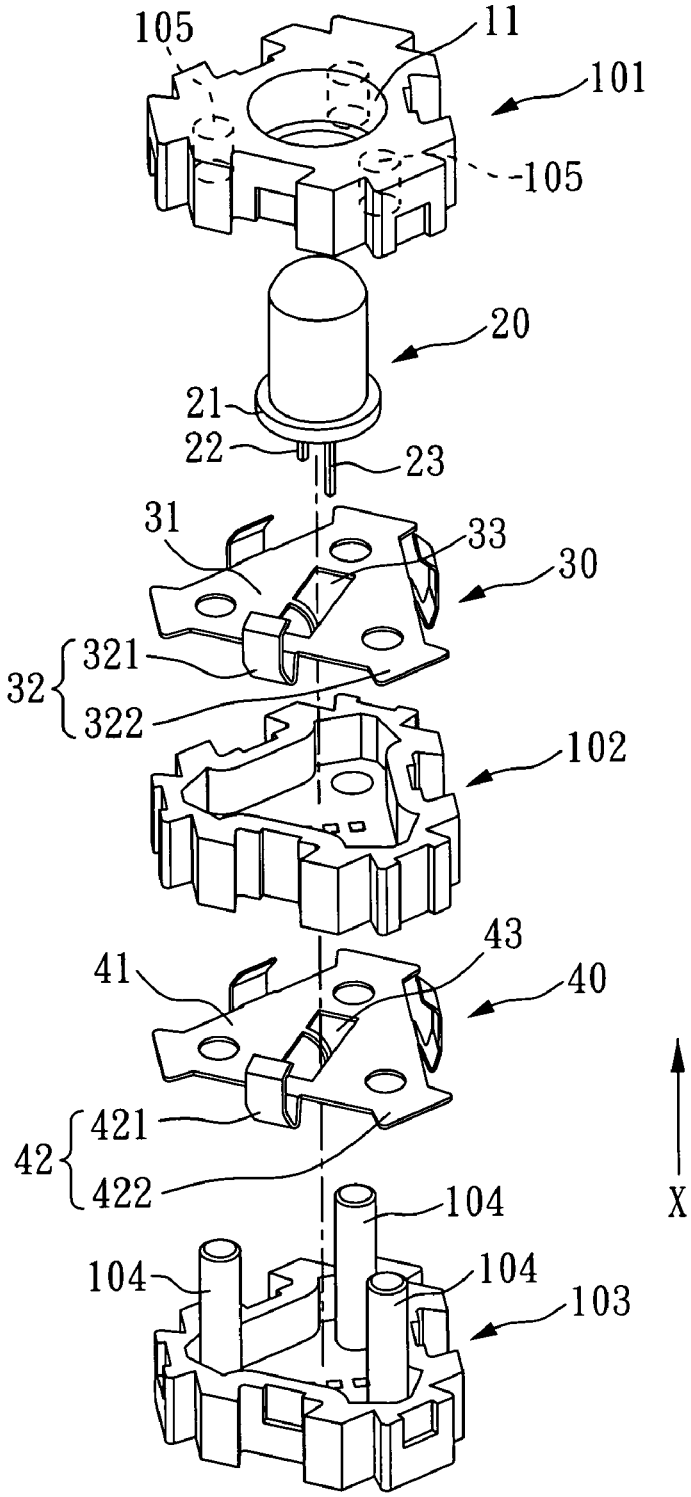
FIG. 1 is an exploded view illustrating a combinational LED lamp according to a first embodiment of the present invention.
Figure 2:
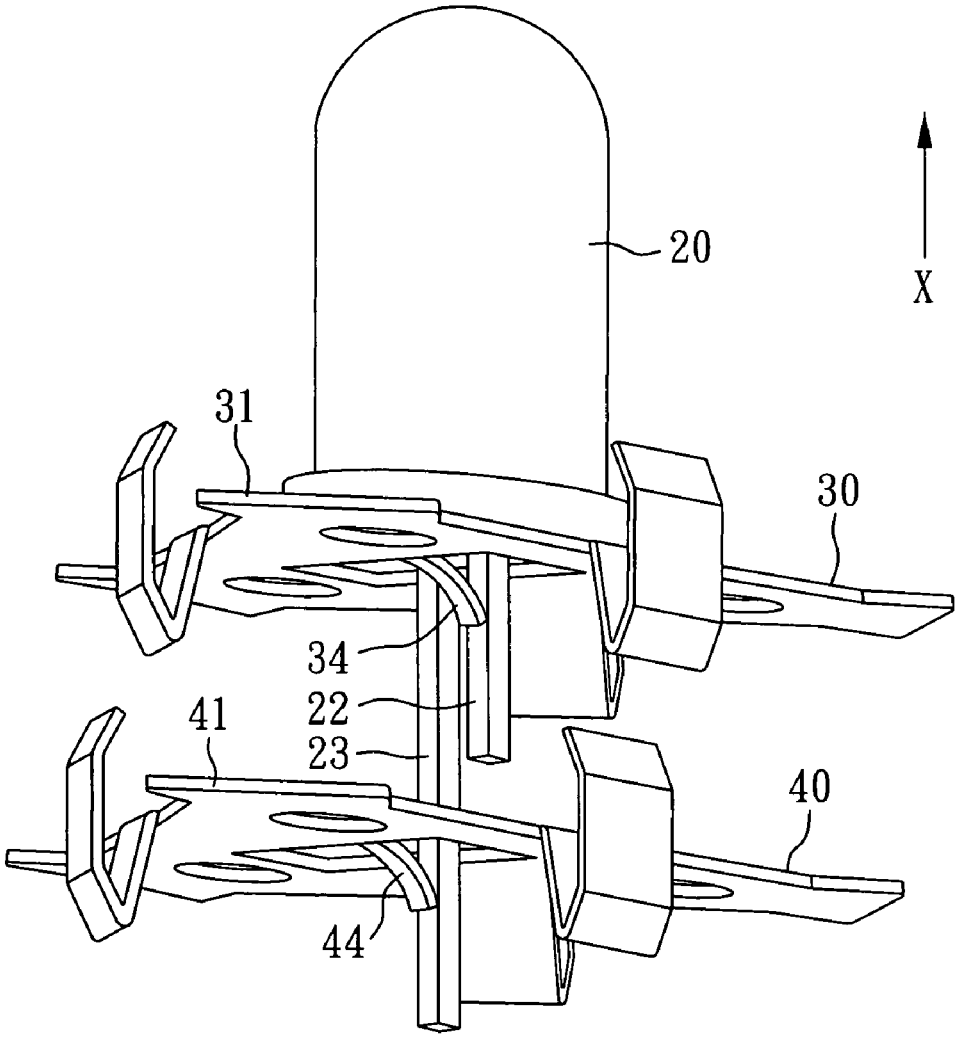
FIG. 2 is a perspective view illustrating interrelation between an LED body and conductive contacts according to the first embodiment of the present invention.
Figure 3:
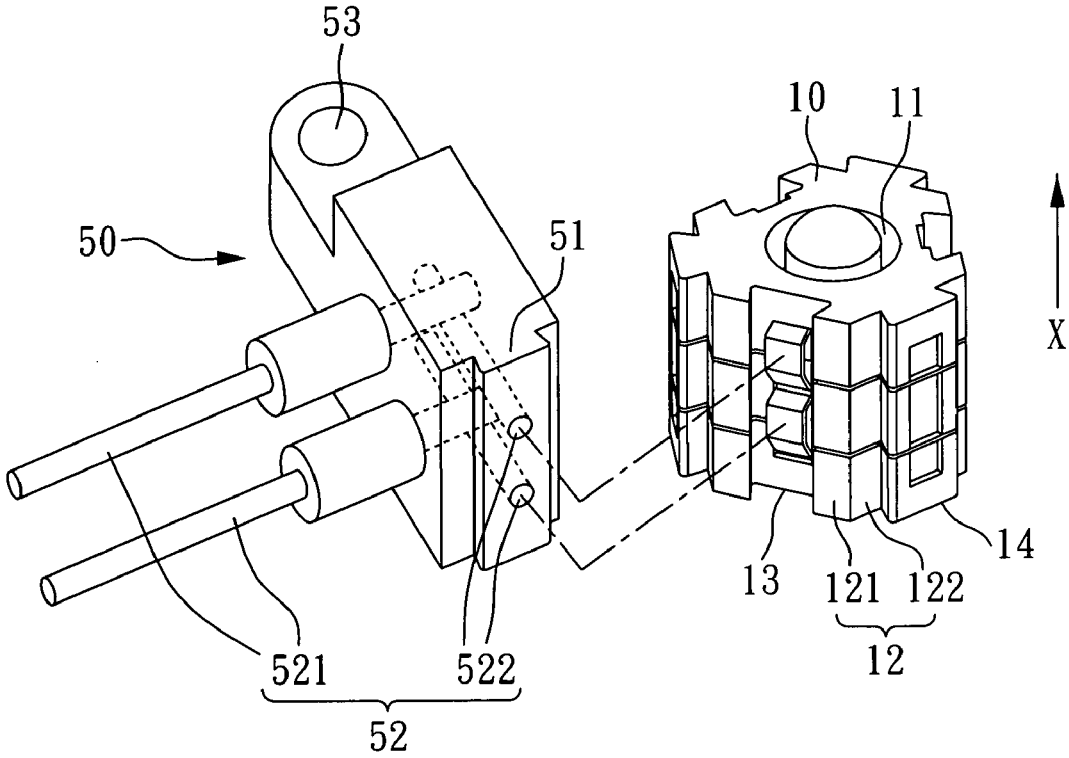
FIG. 3 is a perspective view illustrating the combinational LED lamp according to the first embodiment of the present invention.

Referring to FIG. 1, an exploded view illustrating a combinational LED lamp according to a first embodiment of the present invention, to FIG. 2, a perspective view illustrating interrelation between an LED body and conductive contacts, and to FIG. 3, a perspective view illustrating the combinational LED lamp, the combinational LED lamp comprises a first insulating housing 10, a first LED body 20, a first conductive contact 30, and a second conductive contact 40. The first insulating housing 10 includes a first, a second, and a third unit bodies 101,102,103, where the third unit body 103, the second conductive contact 40, the second unit body 102, the first conductive contact 30, and the first unit body 101 are stacked up, in sequence, from bottom thereof.

According to the present embodiment, the first unit body 101 is provided, in a longitudinal direction X, with a body slot 11 for receiving the first LED body 20. The third unit body 103 is provided with three engaging pillars 104 extending upwardly therefrom. In assembly, the engaging pillars 104 pass, in sequence, through the second conductive contact 40, the second unit body 102, the first conductive contact 30, and eventually to the three engaging holes 105 provided longitudinally at the first unit body 101. Preferably, the engaging pillars 104 are welded, by an ultrasonic welding measure, to the first unit body 101.

Consequently, after the assembly, the first conductive conduct 30, the second conductive contact 40, and the first LED body 20 are all secured to the first insulating housing 10, wherein a flange 21 of the first LED body 20 abuts and is positioned underneath the first unit body 101. As shown in FIG. 3, the first insulating housing 10, after the assembly, becomes a right hexagonal column having six sides, where two adjacent sides are considered an engaging-side set, namely, the first insulating housing 10 includes three neighboring engaging-side sets.

One of the engaging-side sets 12 is herein given as an example, while rest of the engaging-side sets share the same structure. The engaging-side set 12 includes a first engaging surface 121 with a first engaging portion 13, and a second engaging surface 122 with a second engaging portion 14, where the first engaging portion 13 is formed as a longitudinally-extended wedge-like slot, and the second engaging portion 14 is formed as an longitudinally-extended wedge-like block. As such, the first engaging portion 13 can be engaged, correspondingly, with the second engaging portion 14.

The first conductive contact 30 includes an internal section 31 and three external-section sets 32, where each of the external-section sets 32 extends outward from the internal section 31. The external-section set 32 includes two exposure sections 321,322 corresponding to the first engaging surface 121 and the second engaging surface 122 of the first insulating housing 10. The internal section 31 is wrapped up by the first insulating housing 10, and that the exposure sections 321,322 are each exposed from the first and the second engaging surfaces 121,122. Further, there is an opening 33 provided on the internal section 31 of the first conductive contact 30 so as to pass therethrough an elastic piece 34 which is inclined longitudinally.

Still, the second conductive contact 40, like the first conductive contact 30, also includes an internal section 41 and three external-section sets 42, where each of the external-section sets 42 extends outward from the internal section 41. The external-section set 42 includes two exposure sections 421,422 corresponding to the first engaging surface 121 and the second engaging surface 122 of the first insulating housing 10. The internal section 41 is also wrapped up by the first insulating housing 10, that an opening 43 is also provided, and that an elastic piece 44 passing through the opening 43 is inclined longitudinally.

In the present embodiment, the exposure sections 321,421 each appears as a resilient piece of larger dimension, while other exposure sections 322,422 each appears as a lateral piece.

After assembly, the first conductive contact 30 and the second conductive contact 40 are spaced apart, longitudinally, from each other at a predetermined distance by the second unit body 102. The first LED body 20 has a shorter first terminal 22, which is of positive pole, passing through the opening 33 of the first conductive contact 30 and abutting against the elastic piece 34 of the first conductive contact 30. On the other hand, the first LED body 20 has a longer second terminal 23, which is of negative pole, passing through the two openings 33,43 and abutting against the elastic piece 44 of the second conductive contact 40. As such, the first terminal 22 is electrically connected with the first conductive contact 30, and that the second terminal 23 is electrically connected with the second conductive contact 40. Such an elastic-contact design renders a tighter contact between the first LED body 20 and the two conductive contacts 30,40 so as to assure a stable electric conductivity.

Of course, it should be understood that the relationship relative to the positive or negative pole, or to the longer or shorter terminal, as mentioned above, is exemplified only, but not to be limited thereto.

FIG. 3 not only shows a combinational LED lamp, but also an electric adapter 50 for specific use. The electric adapter 50 includes an engaging structure 51 and a positive-negative-terminal set 52, wherein the engaging structure 51 is formed as a wedge-like block, such that the engaging structure 51 can be engaged with the first engaging portion 13 formed as a wedge-like slot. The positive-negative-terminal set 52 exposes from the engaging structure 51. Therefore, when the engaging structure 51 is engaged, longitudinally, with the first engaging portion 13, the positive-negative-terminal set 52 will touch the exposure section 321 of the first conductive contact 30 and the exposure section 421 of the second conductive contact 40 so as to achieve the purpose of electric connection.

In the present embodiment, it is specifically noted that an exposure portion 522 of the positive-negative-terminal set 52 is located at a plane different from that of an external wiring 521 (as shown, both stay at planes perpendicular to each other). Electric adapters provided for the exposure portion 522 and the external wiring 521 in different planes will prevent the exposure portion 522 and the external wiring 521 from interfering with each other so that actual assembly of components becomes more flexible.

The electric adapter 50 is also provided with a hanging hole 53 for hanging a combination of the electric adapter 50 and the LED lamp on a wall.

Figure 4:
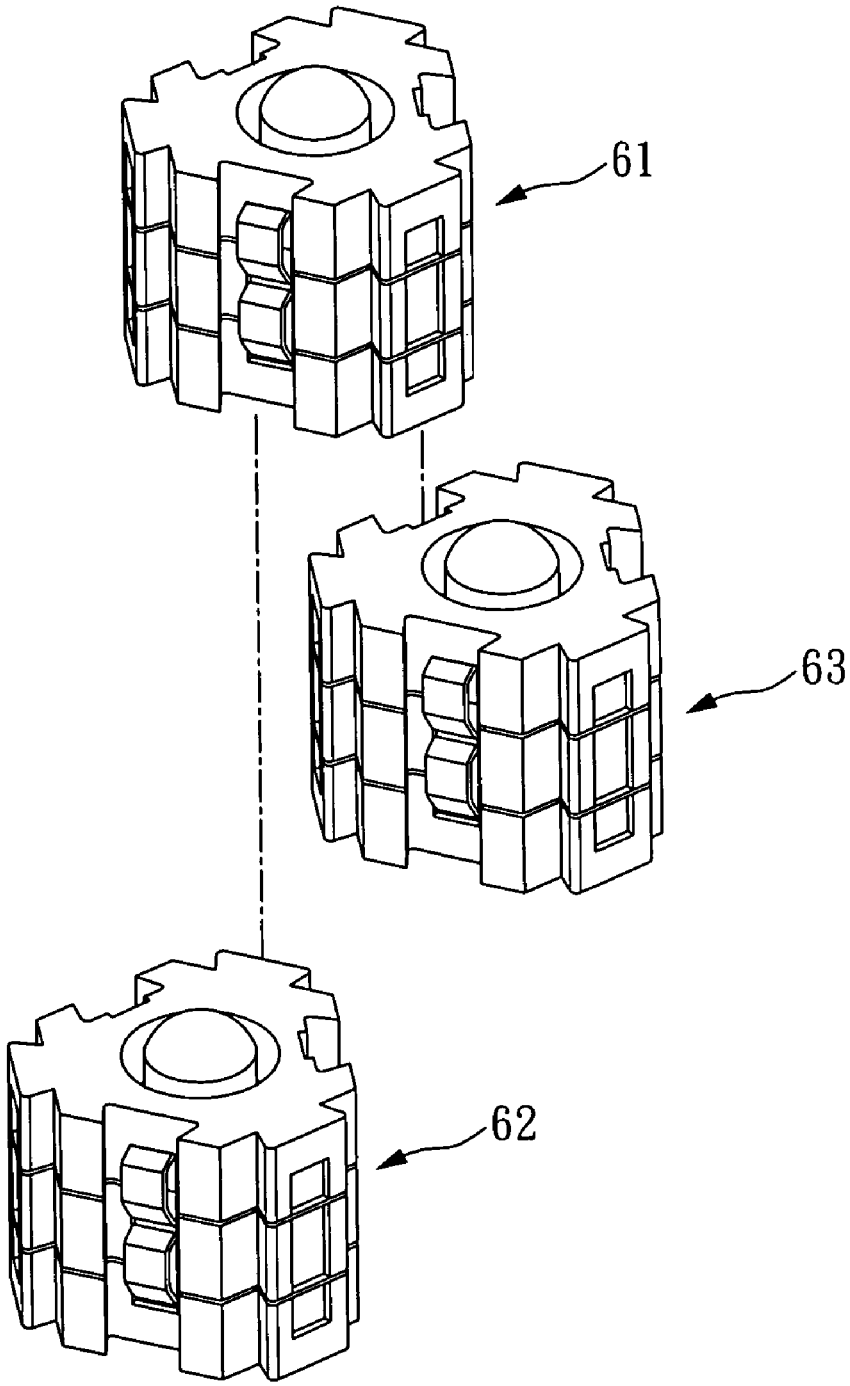
FIG. 4 is a perspective view illustrating a plurality of the combinational LED lamps, according to the first embodiment of the present invention, to be combined together.

Now referring to FIG. 4, a perspective view illustrating a plurality of the combinational LED lamps, according to the first embodiment of the present invention, to be combined together, an LED lamp 61 is combined with an LED lamp 62 in such a manner that a wedge-like slot and a wedge-like block of the LED lamp 61 are engaged, longitudinally, with the wedge-like block of the LED lamp 62, and with the wedge-like slot of the LED lamp 63. In a state of engagement, exposure portion of the wedge-like block contact the exposure portion of the wedge-like slot so as to establish an electric connection. In this manner, theoretically, combinations of the LED lamps, according to the present invention, can be developed endlessly.

Figure 5:
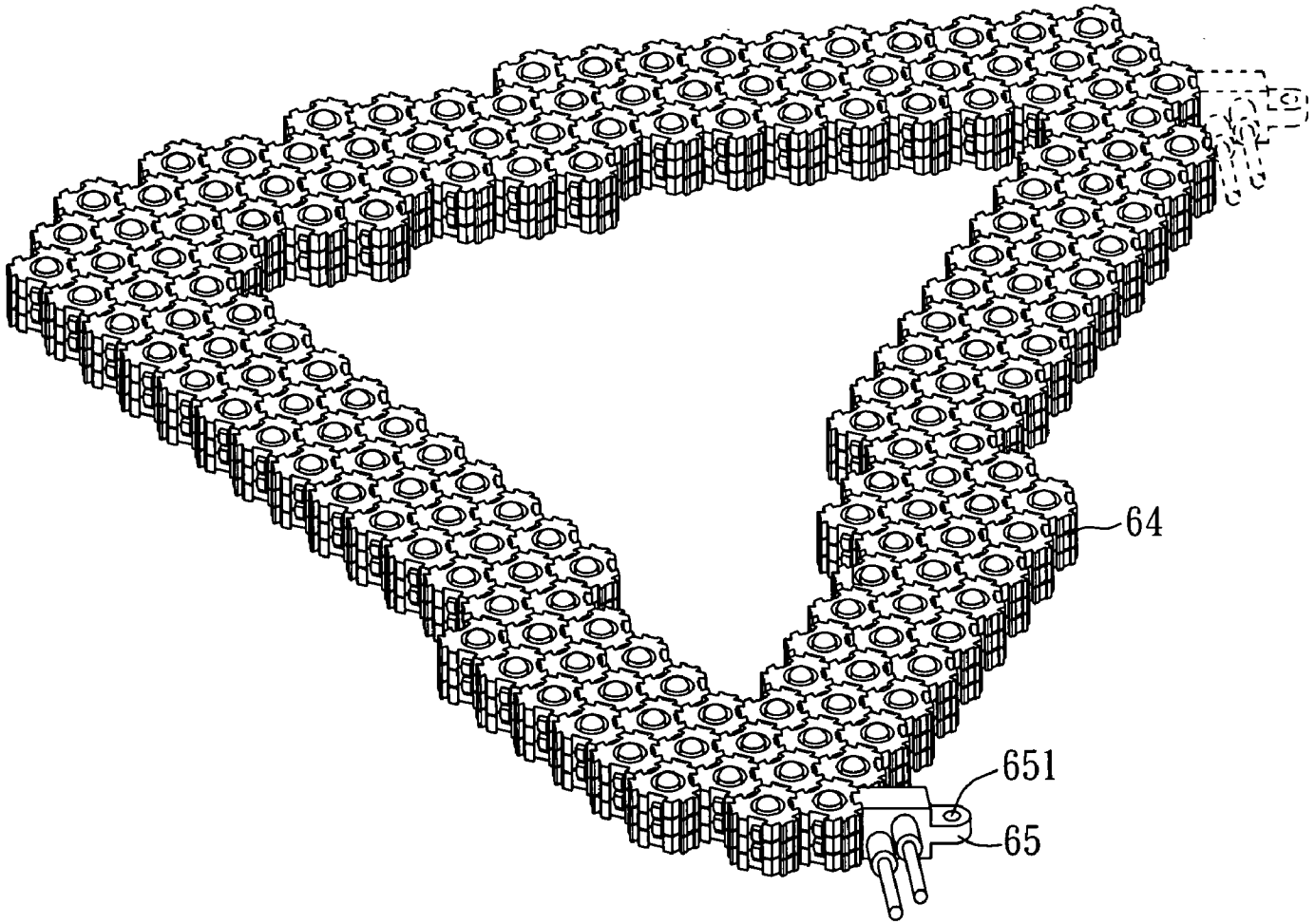
FIG. 5 is a schematic view illustrating a plurality of the combinational LED lamps, according to the first embodiment of the present invention, combined in a heart configuration.

Referring to FIG. 5, a schematic view illustrating a plurality of the combinational LED lamps, according to the first embodiment of the present invention, combined in a heart configuration, in use of the structure shown in FIGS. 3 and 4, one can easily accomplish an LED lamp combination of various configurations by incorporating the LED lamps, such as the LED lamp combination 64 of heart configuration. As shown in FIG. 5, the lamp combination 64 can be hanged at a desirable location, such as on a signboard, by means of the hanging hole 651 of an electric adapter 65. In addition, a location for the electric adapter 65 to be engaged with the lamp combination 64 is not to be limited, for instance, other combinational LED lamp can also be engaged with the electric adapter 65, as shown in dotted lines.

Figure 6:
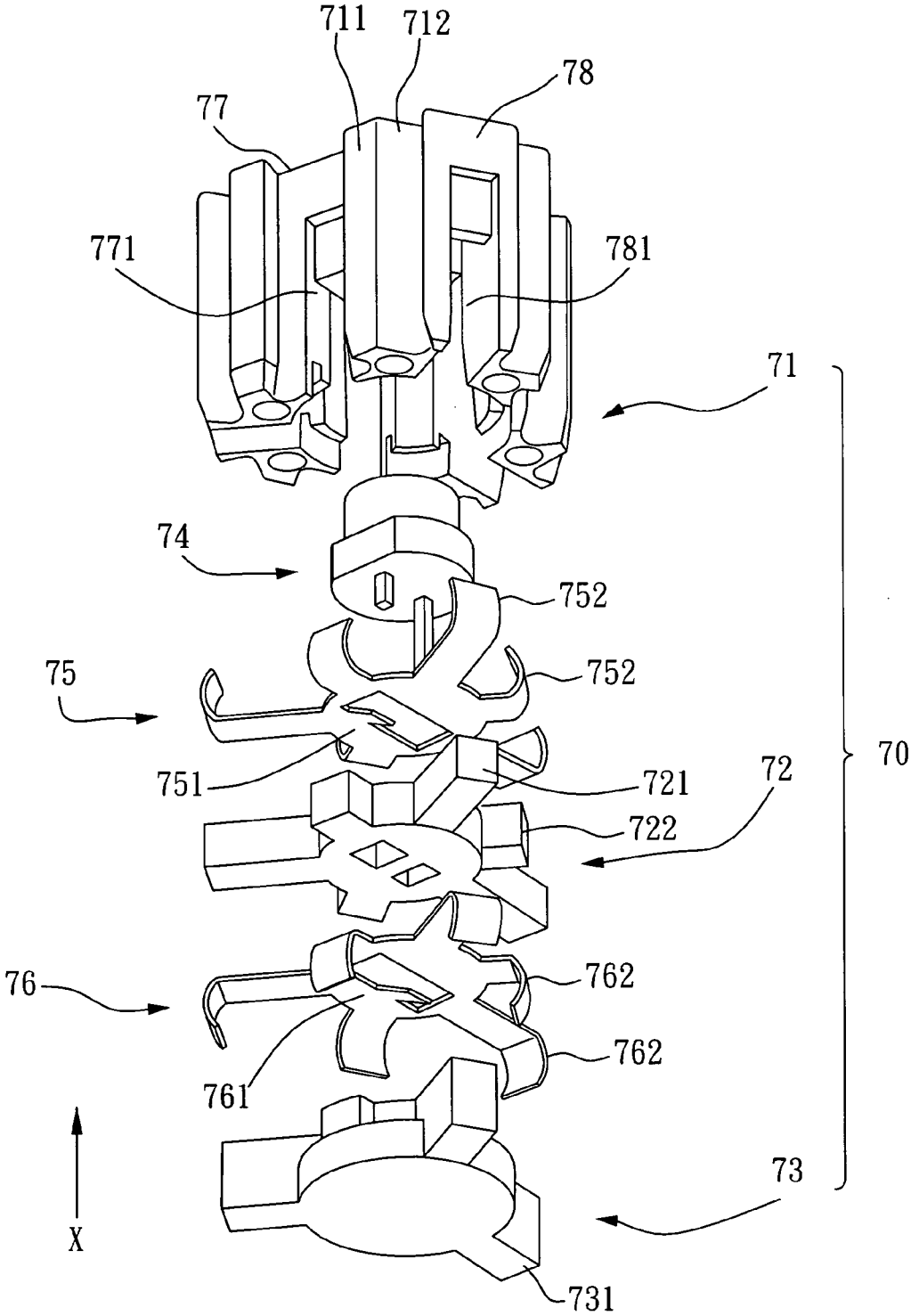
FIG. 6 is an exploded view illustrating a combinational LED lamp according to a second embodiment of the present invention.
Figure 7:
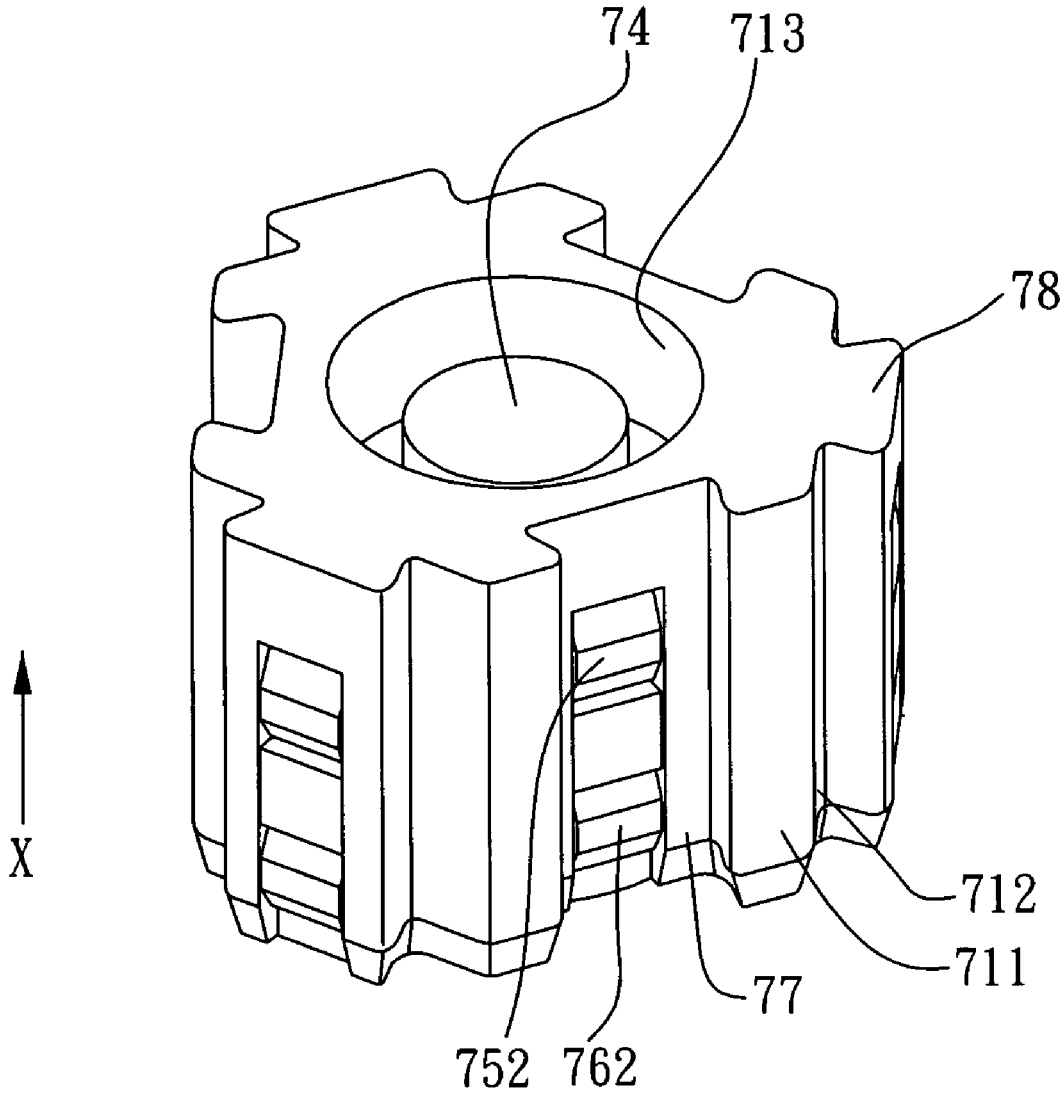
FIG. 7 is a perspective view illustrating the combinational LED lamp according to the second embodiment of the present invention.

Now referring to FIG. 6, an exploded view illustrating a combinational LED lamp according to a second embodiment of the present invention, and to FIG. 7, a perspective view illustrating the combinational LED lamp, similarly, the combinational LED lamp comprises a second insulating housing 70, a second LED body 74, a third conductive contact 75, and a fourth conductive contact 76. The second insulating housing 70 includes a fourth, a fifth, and a sixth unit bodies 71,72,73, which are stacked up from one another, in sequence, from bottom thereof. The configuration of the second insulating housing 70 of the second embodiment is rather different from the first insulating housing 10 of the first embodiment. In the second embodiment, the total longitudinal length of the fourth unit body 71 is almost equal to the total longitudinal length of a completely assembled combinational LED lamp.

In the second embodiment, the fourth unit body 71, at top, is formed as a hexagonal column, and two neighboring sides, such as a third and a fourth engaging surfaces 711,712, are regarded as an engaging-side set, where the fourth unit body 71 includes three engaging-side sets neighboring to one another. The third engaging surface 711 is provided with a third engaging portion 77 formed as a wedge-like slot; and that the fourth engaging surface 712 provided with a fourth engaging portion 78 formed as a wedge-like block. The third engaging portion 77 can be engaged, correspondingly, with the fourth engaging portion 78.

The combinational LED lamp, according to the second embodiment, is assembled in such a manner, like that of the first embodiment, namely, stacked up from bottom to top, the sixth unit body 73, the fourth conductive contact 76, the fifth unit body 72, the third conductive contact 75, the second LED body 74, and eventually the fourth unit body 71. The second LED body 74 is received in a body slot 713 provided, in a longitudinal direction X, in the fourth unit body 71.

Likewise, the third and the fourth conductive contacts 75, 76 each includes an internal section 751,761 and external-section sets. In the present embodiment, each external-section set includes two exposure sections 752,762. The exposure sections 752,762 each appears as a resilient piece of larger dimension.

The third and the fourth engaging portions 77,78 are each provided with a longitudinal slot 771,781 of a predetermined length for receiving and engaging therein with the exposure sections 752,762 of the two conductive contacts 75, 76, six protrusions 721,722 of the fifth unit body 72, and three protrusions 731 of the sixth unit body 73. Thereafter, the fourth, fifth, and sixth unit bodies 71,72,73 are welded appropriately by an ultrasonic welding measure so as to enclose and secure the same. After the assembly, two terminals of the second LED body 74 are electrically connected with the third and the fourth conductive contacts 75,76, respectively.

Although the present invention has been explained in relation to its preferred embodiments, it is to be understood that many other possible modifications and variations can be made without departing from the scope of the invention as hereinafter claimed.

What is claimed is:

1. A combinational LED lamp, comprising;

an insulating housing, including at least one engaging-side set, wherein the engaging-side set includes a first engaging surface and a second engaging surface, and a first engaging portion is formed on the first engaging surface and a second engaging portion on the second engaging surface, and the first engaging portion is engaged with the second engaging portion;

a first conductive contact, being fixed on the insulating housing;

a second conductive contact, being fixed on the insulating housing; and an LED body, being fixed on the insulating housing, and including a first terminal and a second terminal;

wherein both the first and the second conductive contacts include an integral internal section and at least one external-section set corresponding to the engaging-side set, the internal section is located inside the insulating housing, and the external-section set includes two exposure sections exposing at the first engaging surface and the second engaging surface of the insulating housing, and the first terminal of the LED body is electrically connected with the internal section of the first conductive contact, and the second terminal of the LED body with the internal section of the second conductive contact;

wherein the first conductive contact and the second conductive contact are spaced apart, longitudinally, from each other at a predetermined distance, and both the internal sections of the first conductive contact and of the second conductive contact are each provided with an opening for receiving therethrough corresponding first and second elastic pieces which are inclined longitudinally, and the first terminal passes through the opening of the first conductive contact and abuts against the first elastic piece corresponding thereto, and the second terminal passes through the two openings and abuts against the second elastic piece corresponding thereto; and wherein the insulating housing includes three unit bodies stacked up from one another in sequence, and the first conductive contact and the second conductive contact are each interposed between neighboring unit bodies.

2. The combinational LED lamp as claimed in claim 1, wherein the insulating housing is formed as a right polygonal column.

3. The combinational LED lamp as claimed in claim 2, wherein the right polygonal column has even-number sides.

4. The combinational LED lamp as claimed in claim 3, wherein the right polygonal column is a right hexagonal column, and the at least one engaging-side set includes three engaging-side sets neighboring to one another so as to constitute six sides of the right hexagonal column.

5. The combinational LED lamp as claimed in claim 1, wherein the first engaging portion is formed as a wedge-like slot, while the second engaging portion as a wedge-like block.

6. The combinational LED lamp as claimed in claim 5, wherein the wedge-like slot and the wedge-like block are developed longitudinally.

7. The combinational LED lamp as claimed in claim 1, further comprising an electric adapter including an engaging structure and a positive-negative-terminal set, wherein the engaging structure is engaged with the first engaging portion, and the positive-negative-terminal set exposes from the engaging structure so as to contact the exposure section of the first conductive contact and the exposure section of the second conductive contact.

8. The combinational LED lamp as claimed in claim 7, wherein the electric adapter is provided with a hanging hole.

* * * * *